US006711836B2

(12) United States Patent
Weiss

(10) Patent No.: US 6,711,836 B2
(45) Date of Patent: Mar. 30, 2004

(54) SHOE AND METHOD FOR SHOWING INDICIA

(75) Inventor: Howard K. Weiss, New York, NY (US)

(73) Assignee: Deer Stags, Inc., New York, NY (US)

( * ) Notice: Subject to any disclaimer, the term of this patent is extended or adjusted under 35 U.S.C. 154(b) by 0 days.

(21) Appl. No.: 10/007,676

(22) Filed: Nov. 5, 2001

(65) Prior Publication Data

US 2003/0084595 A1 May 8, 2003

(51) Int. Cl.[7] ..... lp;1pA43B 23/00

(52) U.S. Cl. ..... 36/136; 36/112; 36/43

(58) Field of Search ..... 36/83, 132, 136, 36/137, 112, 34 R, 35 R, 37, 43, 44, 25 R, 28; D2/964

(56) References Cited

U.S. PATENT DOCUMENTS

| | | | | | |
|---|---|---|---|---|---|
| 1,952,409 | A | * | 3/1934 | Berg | 40/636 |
| 4,516,337 | A | * | 5/1985 | Adamik | 36/136 |
| 4,697,362 | A | * | 10/1987 | Wasserman | 36/136 |
| 4,712,314 | A | * | 12/1987 | Sigoloff | 36/112 |
| 4,852,276 | A | * | 8/1989 | Savoca et al. | 36/136 |
| 4,955,150 | A | * | 9/1990 | Fagan | 36/136 |
| 5,367,795 | A | * | 11/1994 | Iverson et al. | 36/136 |
| 5,839,211 | A | * | 11/1998 | Pallera | 36/136 |

* cited by examiner

*Primary Examiner*—Jila M. Mohandesi
(74) *Attorney, Agent, or Firm*—Robert S. Lipton, Esq.; Lipton, Weinberger & Husick

(57) ABSTRACT

The invention is an apparatus and method for displaying indicia, such as a logo or trademark, on a shoe. A window is provided in the shoe, for example the heel of the shoe. Indicia appear on a removable member such as an insole and are displayed through the window.

9 Claims, 4 Drawing Sheets

SHOE AND METHOD FOR SHOWING INDICIA

BACKGROUND OF THE INVENTION

1. Field of the Invention

The invention relates to footwear and particularly to the display of indicia, such as logos or trademarks, on an item of footwear. The invention is a shoe having a transparent window. Indicia appear on a removable member engaging an interior surface of the shoe and are visible through the transparent window. A method of practicing the invention also is provided.

2. Description of the Related Art

The footwear business is highly competitive and the display of indicia is commercially desirable. For the purposes of this application, "indicia" mean markings conveying items of information or of decoration. Examples of indicia include logos, trademarks, colors, patterns and artworks. "Identifying indicia" may be used to identify a make or model of shoe or to identify a manufacturer. The term "shoe" means any item of footwear, including without limitation a shoe, boot, athletic or adventure footwear, ski boots, and other similar items.

Modern materials and manufacturing techniques make possible innovation in the display of indicia on a shoe. A shoe may display indicia in any of a number of ways, including printing, embossing, embroidering, through the use of an applique, through the use of a molded shape, and many others. The prior art teaches a transparent air bladder incorporated into the heel or sole of a shoe having indicia located in the interior of the air bladder or incorporated permanently into the structure of the shoe. In the prior art shoe, the indicia are visible through the air bladder. The present invention differs from the prior art in that the indicia are viewed through a window in the shoe, not through an air bladder. Also, the indicia of the present invention appear on a removable member and are not printed on the air bladder or otherwise incorporated permanently into the structure of the shoe.

SUMMARY OF THE INVENTION

The present invention provides for the display of indicia in a shoe. A window is provided in the shoe communicating from an interior surface of the shoe to an exterior surface of the shoe. Indicia appear on a removable member that engages the interior surface of the shoe. The indicia of the removable member are aligned with the window so that the indicia are displayed to an observer through the window. The indicia may be identifying indicia to commercially distinguish the shoe from other makes or models of shoes or to distinguish the shoe from the shoes of other manufacturers.

The use of a removable member allows great flexibility in the use and display of indicia on a shoe. A manufacturer may, for example and without limitation, inexpensively adjust the indicia to reflect local market conditions or languages, to vary the indicia seasonally, to provide private labeling for a retailer, to provide personalized or monogrammed shoes, or to provide any other marking that a consumer may find desirable. The use of the removable member allows a manufacturer, retailer, or other interested person to inexpensively create shoes that, for example, commemorate a special event, affiliation, person, place or product. Indicia appearing on the removable member and displayed in the window may be used to identify any person, item, group, or interest of any kind.

DESCRIPTION OF AN EMBODIMENT

Figure 1:
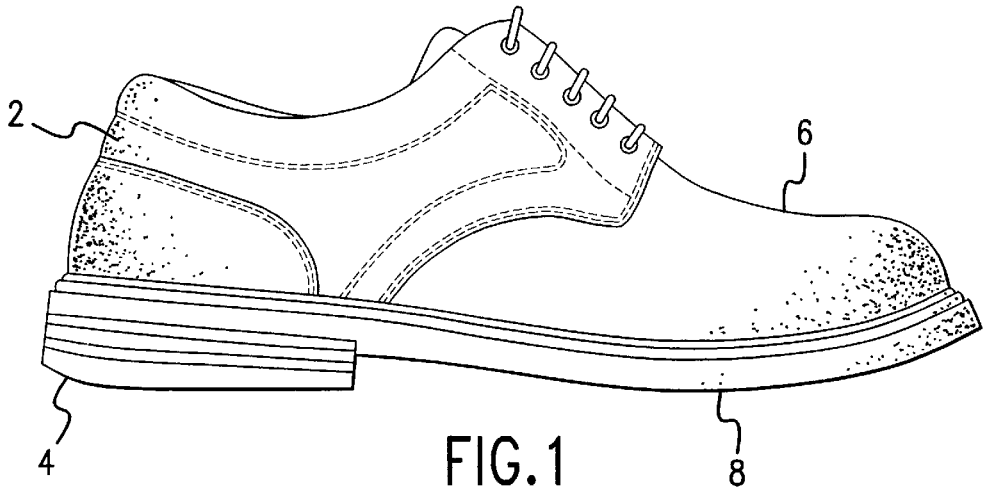
FIG. 1 is a side view of a shoe.
Figure 2:
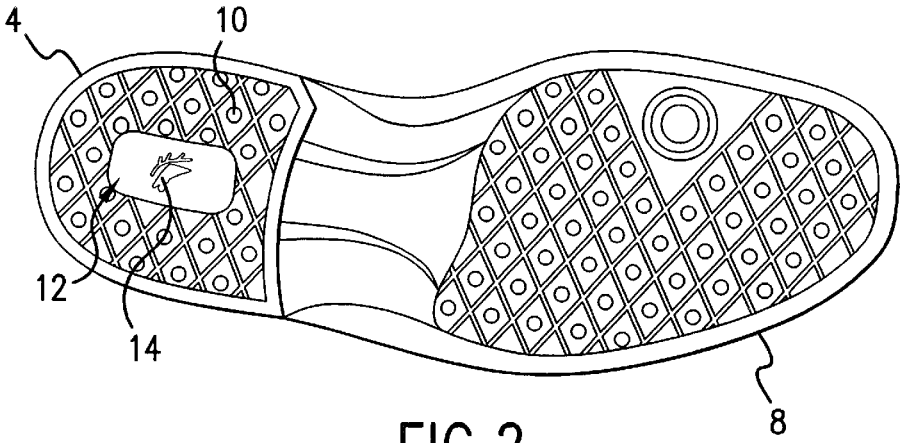
FIG. 2 is a bottom view of a shoe.

Referring to FIG. 1, a shoe 2 has a heel 4, an upper 6 and a sole 8. From FIG. 2, the heel 4 has an exterior surface 10. A window 12 appears in the heel 4. The window 12 is composed preferably of a transparent or semi-transparent polymer forming a durable, water tight seal with heel exterior surface 10.

Indicia 14 are visible to a consumer through the window 12. The indicia 14 may be identifying indicia 14 that convey information such as to identify a make, model or manufacturer of the shoe. The indicia 14 may be decorative or may comprise any marking that a consumer may find commercially desirable.

Figure 3:
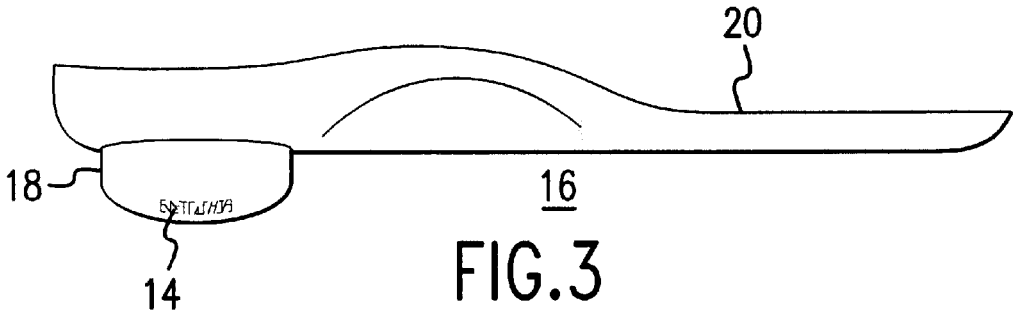
FIG. 3 is a side view of an insole.
Figure 4:
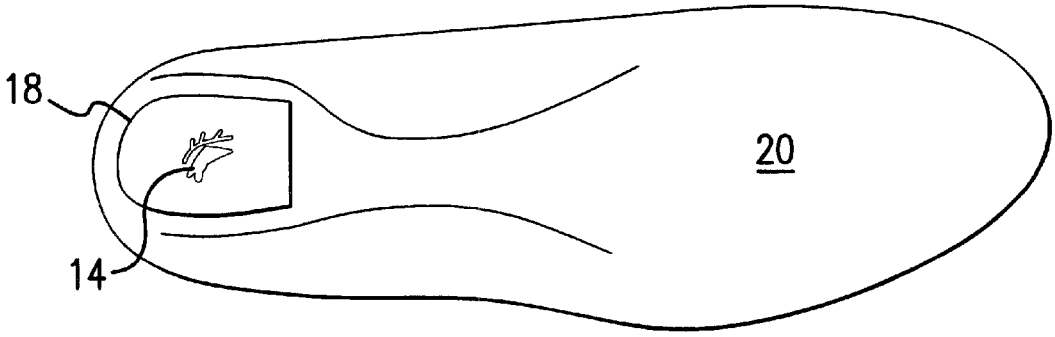
FIG. 4 is a bottom view of an insole.

Indicia 14 appear on a removable member 16 (FIGS. 3, 4). The removable member 16 is placed in the shoe 2 so that indicia 14 are visible through window 12.

The removable member 16 comprises indicia-bearing member 18 bonded to an insole 20. The indicia-bearing member 18 preferably is composed of a resilient material to cushion the foot and to reduce damage to the window 12 resulting from contact between window 12 and indicia-bearing member 18. The preferred material for the indicia-bearing member 18 is a high-memory sponge. An example of such sponge is "Poron®" sold be Rodgers Corporation, which is located in Connecticut. The indicia-bearing member 18 preferably is of a color contrasting to the color of the sole 8. In one embodiment, the indicia-bearing member 18 is yellow in color while the sole 8 is black. The particular indicia 14 and the colors used are a matter of choice to be selected by the designer and are not a part of the invention. The insole 20 preferably also is composed of a resilient material to increase comfort of the wearer.

Figure 5:
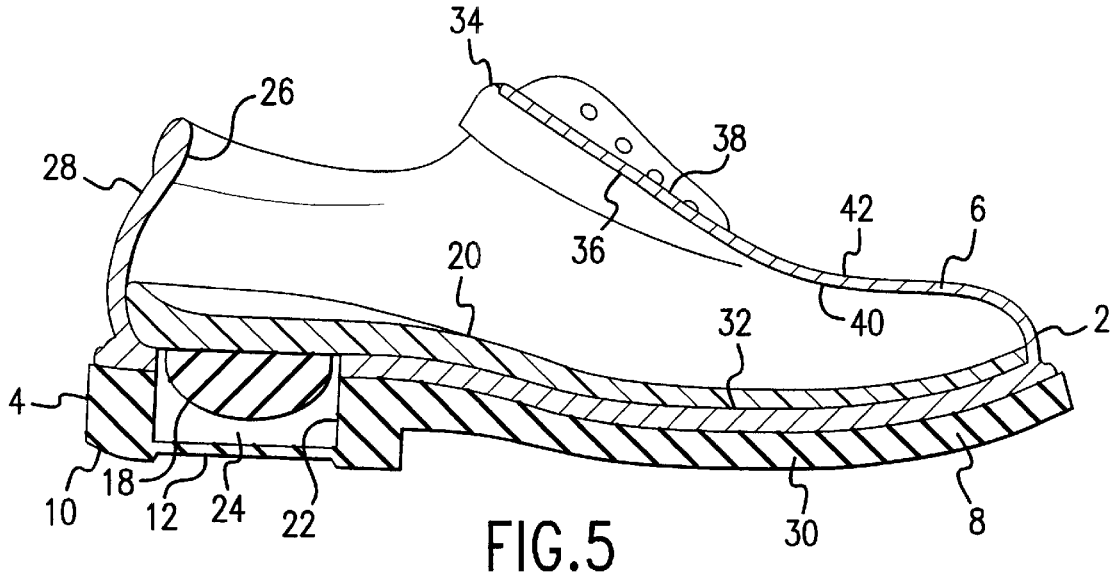
FIG. 5 is a sectional view of a shoe.

FIG. 5 is a cross-section of shoe 2 with insole 20 and indicia-bearing member 18 installed. Heel 4 of shoe 2 defines a heel interior surface 22 and a heel exterior surface 10. Window 12 communicates between the heel interior surface 22 and heel exterior surface 10. When the insole 20 and indicia-bearing member 18 are inserted into shoe 2, indicia 14 are displayed through window 12 to a consumer.

The heel interior surface 22 (FIG. 5) defines a heel interior volume 24. When the insole 20 and indicia-bearing member 18 are installed in shoe 2, the indicia-bearing member 18 intrudes into the heel interior volume 24. The intrusion of the indicia-bearing member 18 into the heel interior volume 24 serves to locate the indicia 14 with respect to the window 12. The indicia 14 preferably are located close enough to the window 12 for ready observation of the indicia 14 by a consumer. The indicia 14 are located at a pre-selected depth from the window 12 to provide a commercially attractive appearance.

While a window 12 communicating through heel 4 is the embodiment described above, other configurations are contemplated by the invention. Window 12 may communicate between any shoe interior surface 26 and any shoe exterior surface 28. For example, window 12 may appear in sole 8 and communicate between sole exterior surface 30 to sole interior surface 32. Window 12 may appear in tongue 34 and communicate between a tongue interior surface 36 and a tongue exterior surface 38. Window 12 may appear in upper 6 and communicate between an upper interior surface 40 and an upper exterior surface 42.

In the event that a window 12 location other than the heel 4 location is selected, a removable member 16 appropriate to the window 12 location also is selected. When a window 12 communicates through an upper 6, a removable member 16 adapted to display indicia 14 through said window 12 is selected. Likewise, when a window 12 communicating through a tongue 34 or a sole 8 is selected, a removable member 16 adapted to display indicia 14 through the window 12 in the tongue 34 or the sole 8 is selected. Without limitation, a removable member 8 in the situation of a window 12 through an upper 6 or tongue 34 may take the form of an insert or shoe liner. A removable member 16 in the situation of a window 12 through a sole 8 may comprise an insole 20.

Indicia 14 include any markings or objects applied to the indicia-bearing member 18 using any means of the art, including without limitation printing, embossing, casting, painting, cutting, carving, burning, melting and molding. Indicia may include contained gases or liquids and may include artificial lights. Indicia 14 also include insertion of objects of any type into heel interior volume 24 for display through window 12.

Figure 6:
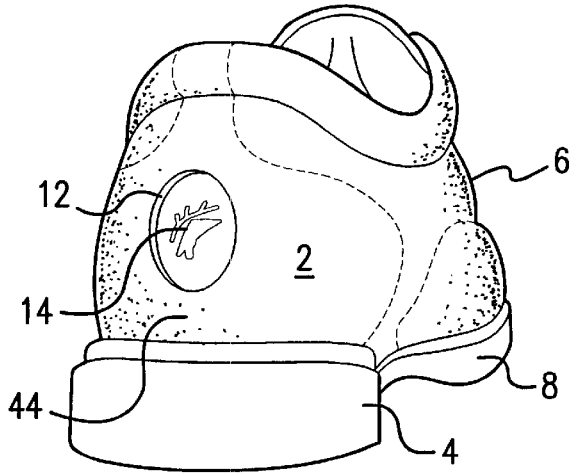
FIG. 6 is a rear perspective view of an alternative embodiment.
Figure 7:
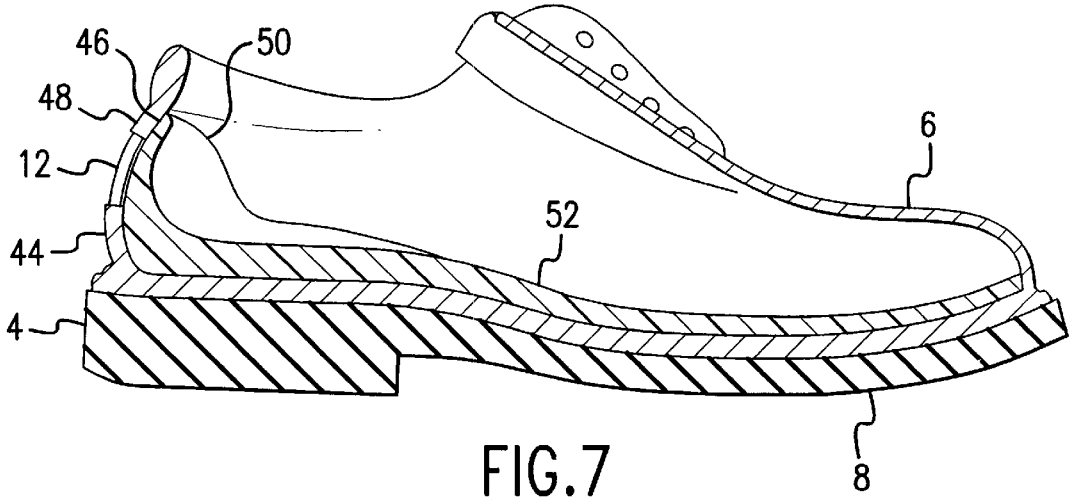
FIG. 7 is a sectional view of an alternative embodiment.

An alternative embodiment is illustrated by FIGS. 6 and 7. Window 12 appears in a shoe counter 44 corresponding to the portion of the upper 6 adjacent to the posterior of heel 4. Window 12 communicates between a counter interior surface 46 and a counter exterior surface 48. Indicia 14 appear on an upward extending portion 50 of alternative insole 52. The upwardly extending portion 50 extends upward from heel 4 so that indicia 14 appearing on the upwardly extending portion 50 are visible through window 12. The location of indicia 14, window 12 and upwardly extending portion 50 may be selected by the designer. Upwardly extending portion 50 may extend above counter 44. Indicia 14 may be embossed or recessed into upwardly extending portion 50 so that indicia 14 appear at a pre-selected distance from window 12 to achieve an aesthetic effect.

The flexibility of the present invention allows inexpensive personalization of said indicia 14 by a manufacturer, retailer, consumer or other interested person. Indicia 14 of any type, such as a monogram, sports team logo, image of a favored motor vehicle, political or religious affiliation, names of loved ones or any information whatsoever may be displayed. A manufacturer may provide supplies to a consumer to personalize the indicia 14 displayed by the removable member 16.

The method of the present invention comprises providing a window 12 communicating from a shoe interior surface 26 to a shoe exterior surface 28 and providing a removable member 16 engaging the shoe interior surface 26, the removable member 16 bearing indicia 14, the indicia 14 being visible through said window 12.

Many different embodiments of the above invention are possible. This Many different embodiments of the above invention are possible. This application is intended to address all possible embodiments and is limited only as described in the following claims.

I claim:

1. An apparatus comprising;

a. a shoe having a shoe interior surface and a shoe exterior surface; and b. a window communicating between said shoe interior surface and said shoe exterior surface; and c. a removable insole having an indicia bearing portion bonded to said insole, said insole engaging said shoe interior surface; and d. indicia appearing on said removable insole, said indicia being aligned with said window such that said indicia may be observed through said window, said window being comprised of a transparent or substantially transparent polymer, said shoe Interior surface being a heel interior surface, said shoe exterior surface being a heel exterior surface said window communicating between said heel exterior surface and said heel interior surface.

2. The apparatus of claim 1, said heel interior surface defining a heel interior volume, said indicia-bearing member extending into said heel interior volume.

3. The apparatus of claim 2, said window being bonded to said heel exterior surface such that said window forms a substantially water-tight seal with said heel exterior surface.

4. An apparatus comprising:

a. a shoe having a counter, a counter Interior surface and a counter exterior surface;

b. a window communicating between said counter Interior surface end said counter exterior surface;

c. an alternative insole engaging said counter interior surface;

d. indicia appearing on said alternative insole, said indicia being aligned with said window such that said Indicia may be observed through said window.

5. The apparatus of claim 4, said window being comprised of a transparent or substantially transparent polymer.

6. The apparatus of claim 1, said window being bonded to said shoe exterior surface such that said window forms a substantially water-tight seal with said counter exterior surface.

7. The apparatus of claim 6, said alternative insole having an upwardly extending portion, said indicia appearing on said upwardly extending portion.

8. A method for displaying indicia on a shoe comprising:

a. providing a window in said shoe, b. providing a removable member exhibiting indicia, c. aligning said removable member and said shoe so that said indicia are displayed in said window;

d. said window communicating between a shoe interior surface and a shoe exterior surface, e. said removable member comprising an Insole and an indicia-bearing member bonded to said insole.

9. The method of claim 8 further comprising:

a. said shoe having a heel, b. said window communicating through said heel.

* * * * *